US011746480B2

(12) United States Patent
Frelich et al.

(10) Patent No.: US 11,746,480 B2
(45) Date of Patent: Sep. 5, 2023

(54) SYSTEM, APPARATUS, AND METHOD FOR CONTROLLING SCREED EXTENDER OF PAVING MACHINE

(71) Applicant: Caterpillar Paving Products Inc., Brooklyn Park, MN (US)

(72) Inventors: Toby A. Frelich, Saint Michael, MN (US); Jacob R. Ellwein, Oak Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 281 days.

(21) Appl. No.: 17/333,051

(22) Filed: May 28, 2021

(65) Prior Publication Data

US 2022/0380989 A1 Dec. 1, 2022

(51) Int. Cl.
*E01C 19/48* (2006.01)
*E01C 23/01* (2006.01)

(52) U.S. Cl.
CPC ..... *E01C 19/4866* (2013.01); *E01C 23/01* (2013.01); *E01C 2301/14* (2013.01)

(58) Field of Classification Search
CPC ... E01C 19/1866; E01C 23/01; E01C 2301/14
USPC ..... 404/72–118
See application file for complete search history.

(56) References Cited

U.S. PATENT DOCUMENTS 5,752,783 A 5/1998 Malone
6,238,135 B1 5/2001 Röwer
9,045,871 B2 6/2015 Graham et al.
9,200,415 B2 12/2015 Graham et al.
9,534,348 B2 1/2017 Rio et al.
10,458,076 B2 10/2019 Marsolek et al.
10,633,803 B2 4/2020 Højland et al.
10,718,092 B2 7/2020 Anheier et al.
11,255,057 B2 * 2/2022 Gallagher ..... E01C 19/42
2004/0071509 A1 4/2004 Frankeny, II
2010/0150651 A1 * 6/2010 Buschmann ..... E01C 19/48 404/82
2010/0183369 A1 7/2010 Lindley
2019/0136464 A1 5/2019 Thieme et al.
2019/0186083 A1 6/2019 Kangas
(Continued)

FOREIGN PATENT DOCUMENTS

CN 103161117 A 6/2013

*Primary Examiner* — Raymond W Addie
(74) *Attorney, Agent, or Firm* — Xsensus, LLP

(57) ABSTRACT

A system, apparatus, and method can control one or more screed extensions or extenders of a paving machine. Such control can include identifying a location of an undesirable surface condition of a mat paved on a base by the paving machine using data from one or more sensors associated with a screed extension; characterizing the undesirable surface condition of the mat; and adjusting a height and/or an angle of attack of an extension plate of the screed extension to prevent future occurrences of the undesirable surface condition responsive to the identification and characterization of the undesirable surface condition. The location of the undesirable surface condition can represent a start of the undesirable surface condition in a transverse direction of the paving machine and can be associated with either an interface between the screed extension and a main screed or outward of the interface, along a length of the extension plate of the screed extension.

20 Claims, 5 Drawing Sheets

(56) References Cited

U.S. PATENT DOCUMENTS

| | | | | |
|---|---|---|---|---|
| 2021/0108378 | A1* | 4/2021 | Green | E01C 19/42 |
| 2021/0277609 | A1* | 9/2021 | Gallagher | E01C 19/48 |

* cited by examiner

SYSTEM, APPARATUS, AND METHOD FOR CONTROLLING SCREED EXTENDER OF PAVING MACHINE

TECHNICAL FIELD

Embodiments of the disclosed subject matter relate to systems, apparatuses, and methods for controlling a screed of a paving machine, and more particularly to systems, apparatuses, and methods for controlling one or more screed extenders of paving machines.

BACKGROUND

Paving machines are used to apply, spread, and compact a mat of material relatively evenly over a desired base. These machines are regularly used in the construction of roads, parking lots, and other areas where a smooth durable surface is required for cars, trucks, and other vehicles to travel. Generally, a paving machine can include a hopper to receive paving material from a truck and a conveyor system to transfer the paving material from the hopper for discharge onto a base. Screw augers may be used to spread the paving material transversely across the base in front of a screed assembly. The screed assembly can smooth and somewhat compact the paving material, for instance, leaving a mat of uniform depth and smoothness.

The screed assembly can be drawn behind the paving machine by a pair of pivotally mounted tow arms and can include a main screed and one or more screed extensions or extenders disposed behind (or, in some embodiments, in front of) and adjacent to the main screed. The screed extension(s) can be slidable transversely to the direction of travel of the paving machine and allow varying widths of paving material to be laid.

Road mat thickness can be determined, in part, by the position of the tow arms and the angle of attack of the screed assembly relative to the base. To pave an even surface, the trailing edge of the main screed, and at least the inner end of the trailing edge of the screed extension may be controlled to remain in the same plane. A change in the vertical height of the tow arms may cause the trailing edge of the main screed to be disposed at a different elevation compared to the trailing edge of one or more of the screed extensions, at least temporarily. This difference in elevation can cause inconsistencies or discontinuities in the paved mat.

U.S. Pat. No. 9,534,348 ("the '348 patent") describes a paving machine for reducing transition marks in a mat. According to the '348 patent, a sensor is configured to sense transition marks in the mat proximal to an intersection between the first and second surface sections and to transmit data indicative of such to the controller. The '348 patent also describes that the controller may be configured to determine from the data received from the sensor when the inner end of an extension trailing edge of an extension plate is disposed above or below the first plane, and move the inner end to the first plane.

SUMMARY

According to an aspect of the present disclosure a method is disclosed or implemented. The method, which can be performed based on a non-transitory computer-readable storage medium having stored thereon instructions that, when executed by one or more processors, cause the one or more processors to perform the method, can comprise: identifying a location of an undesirable surface condition of a mat paved on a base by the paving machine using data from one or more sensors associated with a screed extension; characterizing the undesirable surface condition of the mat; and adjusting a height and/or an angle of attack of an extension plate of the screed extension to prevent future occurrences of the undesirable surface condition responsive to the identification and characterization of the undesirable surface condition. The location of the undesirable surface condition can represent a start of the undesirable surface condition in a transverse direction of the paving machine and can be associated with either an interface between the screed extension and a main screed or outward of the interface, along a length of the extension plate of the screed extension.

In another aspect, a method for controlling a paving machine is disclosed or implemented. The machine can comprise: determining, using a controller, with the paving machine stationary, a first angle of attack of a screed extension of the paving machine, said determining being based on angle of attack data from an angle of attack sensor associated with the screed extension; comparing, using the controller, with the paving machine stationary, the first angle of attack of the screed extension with a second angle of attack of a main screed of the paving machine; determining, using the controller, with the paving machine stationary, whether a result of said comparing exceeds a predetermined threshold; and adjusting, under control of the controller, with the paving machine stationary, the first angle of attack of the screed extension to within the predetermined threshold responsive to a condition where the result exceeds the predetermined threshold. The predetermined threshold can represent a dead band to account for acceptable dynamic movement of the screed extension during paving operations of the paving machine.

And in another aspect a paving machine for paving a mat on a base is disclosed or provided. The paving machine can comprise: a plurality of sensors to sense a surface characteristic of the mat; a screed assembly; and a controller operatively coupled to the sensors and the screed assembly. The screed assembly can include: a main screed having a main screed plate, a first screed extension having a first extension plate, the first extension plate defining a first rear edge of the first screed extension, and the first screed extension being configured to be positioned outward of the main screed on a first end of the main screed in a front elevational view of the screed assembly, and a second screed extension having a second extension plate, the second extension plate defining a second rear edge of the second screed extension. The second screed extension can be configured to be positioned outward of the main screed on a second end of the main screed opposite the first end in the front elevational view of the screed assembly. A first set of the plurality of sensors can be to sense the surface characteristic of the mat associated with the first extension plate of the first screed extension. A second set of the plurality of sensors can be to sense the surface characteristic of the mat associated with the second extension plate of the second screed extension. The controller can be configured to, for each of the first extension plate and the second extension plate: identify, as said surface characteristic, a location of a ridge formed in the mat associated with the first extension plate or the second extension plate, using data from the first set of sensors or the second set of sensors, respectively, the ridge running in a direction of travel of the paving machine, and the location of the ridge being associated with either an inner end of the first extension plate or the second extension plate or outward of the inner end, along a length of the first extension plate or the second extension plate, and control a height of the first extension plate or the second extension plate responsive to the identification of the location of the ridge.

Other features and aspects of this disclosure will be apparent from the following description and the accompanying drawings.

BRIEF DESCRIPTION OF DRAWINGS

FIG. 2 is a perspective view of the screed assembly of FIG. 1 including a main screed including a main screed plate and screed extensions each including an extension plate; for clarity the screed assembly is shown without the operator step, gates, handle, side plates, and the like.

DETAILED DESCRIPTION

Embodiments of the disclosed subject matter relate to systems, apparatuses, and methods for controlling a screed of a paving machine, and more particularly to systems, apparatuses, and methods for controlling one or more screed extenders or extensions of a paving machine.

Figure 1:
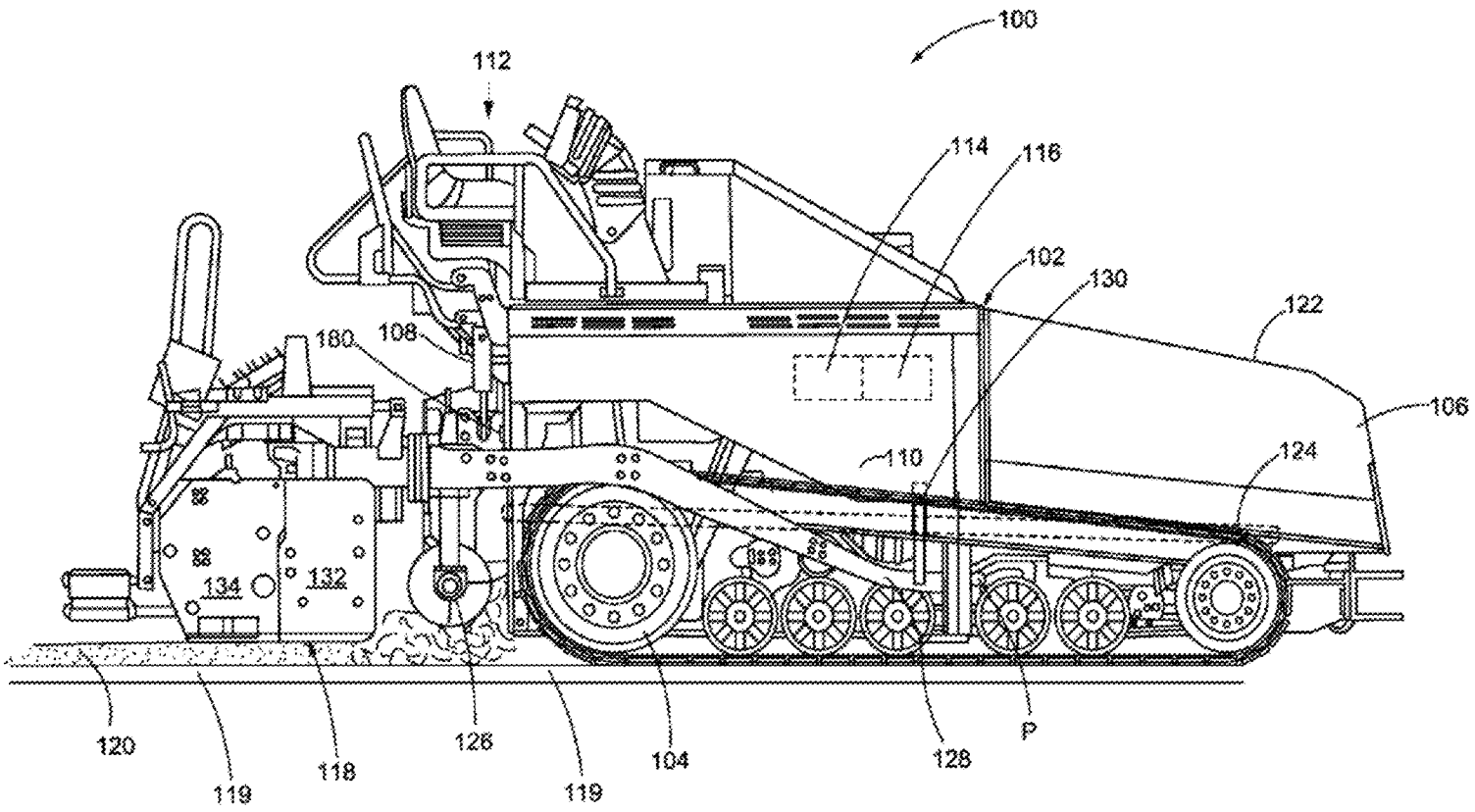
FIG. 1 is a diagrammatic side view of an exemplary paving machine having tow arms that tow an exemplary screed assembly.

FIG. 1 illustrates one example of a paving machine 100 that can incorporate features of the present disclosure, though embodiments of the disclosed subject matter are not so limited. Generally, the paving machine 100 can pave a layer or mat 120 of paving material on a base 119.

The paving machine 100 can include a frame 102 coupled to a set of ground-engaging elements 104, such as wheels or tracks, coupled to the frame 102. The frame 102 can have a front 106, a rear 108, and opposing sides 110. An operator station 112 may be mounted to the frame 102. In one embodiment, the operator station 112 may be mounted to the frame 102 proximal to the rear 108 of the frame 102. An engine 114 may provide power to the ground-engaging elements 104 and a final drive assembly via mechanical or electric drive drain. The engine 114 may further drive an associated generator 116 that can be used to power various systems on the paving machine 100. A screed assembly 118 may be attached at the rear 108 of the frame 102 to spread and compact paving material into the layer or mat 120 of desired thickness, size, and uniformity on the base 119.

The paving machine 100 may further include a hopper 122 to store a paving material, and a conveyor system including one or more conveyors 124 to move paving material from the hopper 122 to the screed assembly 118 at the rear 108 of the frame 102. The conveyors 124 may be arranged at the bottom of the hopper 122 and, if more than one is provided, may be positioned side-by-side and run parallel to one another back to the rear 108 of the frame 102. While an endless path conveyor 124 is shown, one or more feed augers or other material feed components may be used instead of or in addition to the conveyor 124.

One or more augers 126 may be arranged near the rear 108 of the frame 102 to receive the paving material supplied by the conveyor 124 and spread the material evenly beneath the screed assembly 118. Although only one auger 126 is shown in FIG. 1, the paving machine 100 may have a single auger or any number of augers.

The screed assembly 118 can be connected to the frame 102 by a pair of tow arms 128 (only one of which is visible in FIG. 1) that extend between the frame 102 and the screed assembly 118. The tow arms 128 can be connected to the frame 102 and pivotable about a pivot point P. Tow arm actuators 130 can be operably connected to the tow arms 128 and the frame 102. The tow arm actuators 130 can be operated to raise and lower the tow arms 128 about pivot point P (in a direction perpendicular to the base 119 to be paved) and thereby raise and lower the screed assembly 118. The tow arm actuators 130 may be any suitable actuators, such as hydraulic cylinders.

Figure 2:
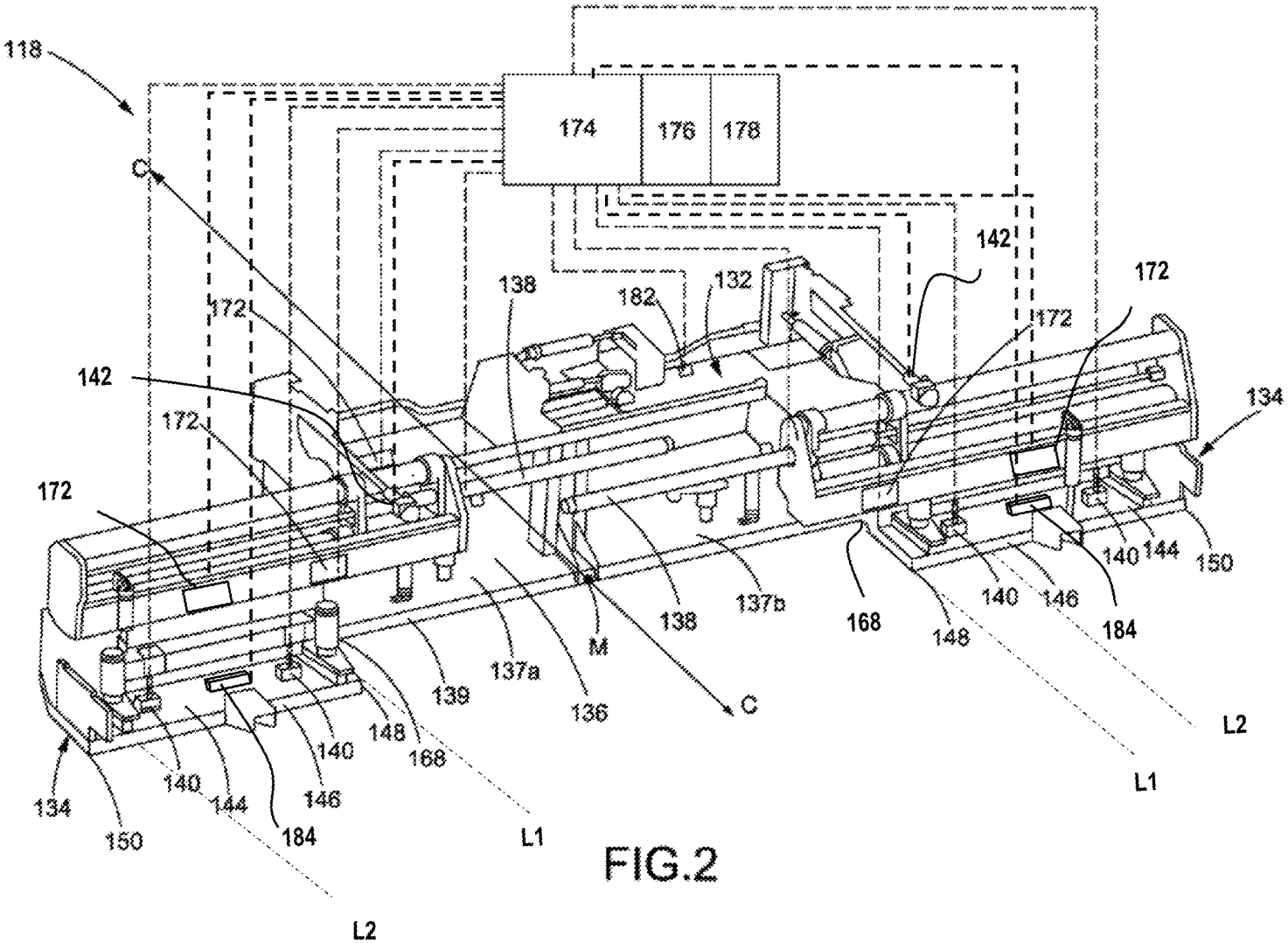

FIG. 2 illustrates an exemplary screed assembly 118 that can include a main screed 132 and one or more screed extenders or extensions 134. The main screed 132 may include a main screed plate 136. Likewise, each screed extension 134 can include an extension plate 144. In operation, the main screed plate 136 and the one or more screed extensions 134 can smooth and compress paving material as the screed assembly 118 (and thus the main screed 132 and the one or more screed extensions 134) is floatingly pulled by the paving machine 100 (and tow arms 128) over the paving material.

The main screed plate 136 may be comprised of a single plate or a plurality of connected plate sections. Such connected plate sections may, in some embodiments, be disposed at an angle with respect to each other (or moveable to such an angle) in order to provide a crowned paved surface. For example, in the exemplary screed assembly 118 shown in FIG. 2, the main screed plate 136 can include right and left plate sections 137*a*, 137*b* connected to one another along a centerline C that extends (in the direction of paving machine 100 travel) through a midpoint M of the main screed plate 136, where the midpoint M can be disposed at a point half of the distance across the main screed plate 136 in a direction that is transverse to the direction of travel of the paving machine 100. The right and left plate sections 137*a*, 137*b* can be connected to one another so as to be capable of being disposed at the angle relative to each other (about the centerline C) in order to provide the crowned paved surface.

Figure 3:
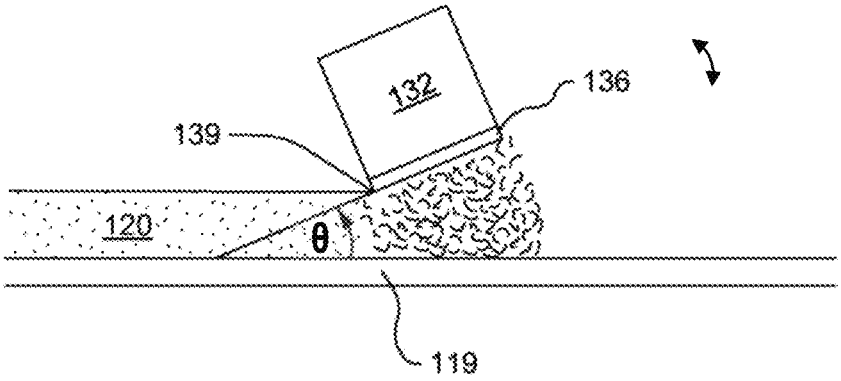
FIG. 3 is a schematic representation of the angle of attack of the main screed plate.

The main screed plate 136 can include a main screed trailing edge 139. The main screed trailing edge 139 can have an inside end 168 disposed adjacent to each of the extension plates 144. As shown in FIG. 3, the main screed plate 136 may be oriented at a slope or an angle θ relative to the base 119, particularly with the main screed trailing edge 139 at a height below a leading edge of the main screed plate 136, such that the main screed trailing edge 139 defines the surface of the mat 120 paved by the main screed plate 136. Such angle θ of the main screed plate 136 may be referred to as an angle of attack of the main screed 132 (or the main screed plate 136). In this regard, with the leading edge of the main screed plate 136 at a height above the main screed trailing edge 139, such as shown in FIG. 3, such positioning may be referred to as a positive angle of attack. Conversely, a negative angle of attack for the main screed plate 136 can be defined or characterized as a positioning whereby the main screed trailing edge 139 is at a height above the leading edge of the main screed plate 136.

As shown in FIG. 2, screed extension(s) 134 may be provided behind and adjacent to the main screed 132, although, in other embodiments, the screed extension(s) 134 may, alternatively, be positioned in front of the main screed 132. The embodiment shown in FIG. 2 has two screed extensions 134, one disposed on either side of the main screed 132, though embodiments of the disclosed subject matter are not so limited. Each of the screed extensions 134 may be slidably movable, in a parallel direction relative to the main screed 132, between retracted and extended positions, so that varying widths of paving material can be laid. This slidable movement can be transverse or perpendicular to the direction of travel of the paving machine 100. The parallel movement of the screed extensions 134 relative to the main screed 132 may be driven by respective powered screed width actuators 138, such as hydraulic or electric actuators.

Each screed extension 134 may also be configured such that the height of the screed extension 134 (and its extension plate 144) can be adjusted, i.e., moved up or down, relative to the base 119 (and the main screed plate 136 of the main screed 132), for instance, during paving. As shown in FIG. 2, the height of the screed extension 134 may be adjusted by powered height actuators 140, such as hydraulic or electric actuators. According to one or more embodiments, the height of one extension plate 144 may be controlled (i.e., maintained, raised, or lowered) independent of the control of any other extension plate(s) 144.

The extension plate 144 can include an extension trailing edge 146, which may also be referred to as an extension rear edge. The extension trailing edge 146 may be the lower edge of the extension plate 144 that can be in contact with the paved mat 120. As shown in FIG. 2, the extension trailing edge 146 can have an inner end 148 and an outer end 150. The inner end 148 can be proximal to the centerline C extending in the direction of travel through the midpoint M of the main screed plate 136, whereas the outer end 150 can be distal to the centerline C. In the case where both extension plates 144 are extended by a same amount, the midpoint M can be disposed at a point half of the distance across the main screed plate 136 and the extension plates 144 in a direction that is transverse to the direction of travel of the paving machine 100.

Figure 4:
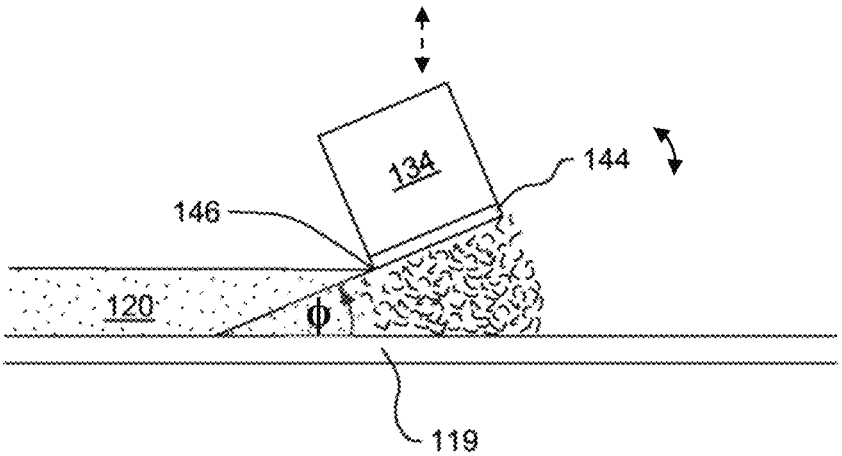
FIG. 4 is a schematic representation of the angle of attack of the extension plate.

As shown in FIG. 4, each extension plate 144 may be oriented at a slope or angle $\phi$ relative to the base 119 to be paved. In some embodiments, the entire extension trailing edge 146 and the main screed trailing edge 139 may be in the same plane, whereas in other embodiments, only a portion of the extension trailing edge 146 and the main screed trailing edge 139 may be in the same plane, namely the part of the extension trailing edge 146 that intersects the plane that contains the main screed trailing edge 139.

According to one or more embodiments, the extension plate 144 may be oriented at the slope or angle $\phi$ relative to the base 119 to be paved, particularly with the extension plate trailing edge 146 at a height below a leading edge of the extension plate 144, such that the extension plate trailing edge 146 defines the surface of the mat 120 paved by the extension plate 144. Such angle $\phi$ of the extension plate 144 may be referred to as an angle of attack of the extension plate 144.

The angles of attack $\phi$ for the extension plates 144 may be the same or different. Likewise, the angle of attack $\phi$ of each extension plate 144 may be the same as the angle of attack $\theta$ of the main screed plate 136. In this regard, with the leading edge of the extension plate 144 at a height above the extension plate trailing edge 146, such as shown in FIG. 4, such positioning may be referred to as a positive angle of attack. Conversely, a negative angle of attack for the extension plate 144 can be defined or characterized as a positioning whereby the extension plate trailing edge 146 is at a height above the leading edge of the extension plate 144. Thus, the extension plate 144 can be rotated clockwise (in FIG. 4) to decrease the positive angle of attack and rotated counterclockwise to increase the positive angle of attack. According to one or more embodiments, the angle of attack $\phi$ of the extension plate 144 may be defined relative to the angle of attack $\theta$ of the main screed plate 136.

According to one or more embodiments, the screed assembly 118 can have at least one powered screed extension angle of attack actuator 142 for each screed extension 134 (and extension plate 144). The powered screed extension angle of attack actuator 142 can be comprised of an electric motor, gear drive, etc. Generally, the powered screed extension angle of attack actuator 142 can rotate the extension plate 144 to change the angle of attack of the extension plate 144. The powered screed extension angle of attack actuator 142 can be independently controlled. Hence, the angle of attack of each extension plate 144 may be controlled (i.e., maintained, increased, or decreased) independent of the control for the other extension plate(s) 144.

Referring again to FIG. 2, the paving machine 100 may further include one or more sensors 172. The sensor(s) 172 may be mounted on or in association with the screed assembly 118. In one or more embodiments, one or more of the sensors 172 may be mounted in association with each of the screed extensions 134 (FIG. 2 shows two sensors 172 mounted on each screed extension 134). One or more of the sensors 172 may also be mounted in association with the main screed 132, for instance, one for each plate section 137*a*, 137*b*.

Each sensor 172 may directly sense or detect one or more undesirable surface conditions of the mat 120 itself, as the mat 120 is being processed by the screed assembly 118, for instance, rather than sensing or detecting aspects of the paving machine 100 itself. Of course, embodiments of the disclosed subject matter may also sense or detect aspects of the paving machine 100 itself to control the screed extensions 134. According to one or more embodiments, such direct sensing or detecting using the sensor 172 may be or include a change in the surface conditions of the mat 120 as the paving machine 100 processes the paving material to create the mat 120. Such undesirable surface conditions of the mat 120 may include undesirable characteristics or features, such as a transition mark (e.g., a transition line or ridge), made in or on the mat 120 during operation of the paving machine 100. Moreover, undesirable surface conditions of the mat 120, according to embodiments of the disclosed subject matter, may pertain to the pavement of flat surfaces for the mat 120 and may exclude transitions associated with an intentionally created sloped shoulder (e.g., caused by non-planar rotation of the screed extension 134). Additionally or alternatively, such undesirable surface conditions of the mat 120 may be or include a difference in texture and/or a difference in density of the mat 120.

Incidentally, transition marks may happen in a number of ways. For example, if the main screed trailing edge 139 and the extension trailing edge 146 are offset (in the direction of paving machine 100 travel), yet disposed in (and pave in) the same plane, transition marks in the form of transition ridges may occur when the tow arms 128 are adjusted up or down at (or adjacent to) the pivot point P. A transition mark in the form of the transition ridge may be defined as a step or disconnect in the surface of the mat 120 due to changes in the elevation of adjacent surface sections.

The sensors 172 may be or include a visual sensor (e.g., a digital camera, smart camera), LiDAR, a sonic sensor, or a combination of two or more of such sensors. According to one or more embodiments, the sensor 172 can be characterized as a non-contact sensor, which can mean that the sensor 172 does not need to physically contact the mat 120 to detect surface conditions of the mat 120.

FIG. 2 shows examples of undesirable surface conditions of the mat 120 in the form of transition marks or lines L1, L2. Notably, though two are shown per extension plate 144, only one of the transition mark L1 or transition mark L2 may be created by the paving operation at one time. As shown, during operation of the paving machine 100 moving in the moving direction of the paving machine 100, each transition mark L1/L2 can extend from the rear of the screed assembly 118 parallel to the moving direction of the paving machine 100.

Generally, the transition mark L1 may be formed in a case where the height of the extension plate 144 is too low relative to the height of the main screed plate 136, whereas the transition mark L2 may be formed in a case where the height of the extension plate 144 is too high of the main screed plate 136. Moreover, each of the transition mark L1 and the transition mark L2 may represent a start of an undesirable surface condition in the traverses direction relative to the moving direction of the paving machine 100. That is, according to one or more embodiments, the surface condition of the mat 120 inward of the transition mark L1/L2 may not have an undesirable condition, where the transition mark L1/L2 represents the start or beginning of the undesirable surface condition of the mat 120 outward (transversely) from the transition mark L1/L2 to the outer end 150 of the extension trailing edge 146 of the extension plate 144.

As noted above, each sensor 172 is configured to sense or detect the corresponding transition mark L1, L2. For instance, in a case of only one sensor 172 per extension plate 144, the field of view (FOV) of the sensor 172 can be wide enough to detect any transition mark occurring at the inner end 148 of the extension trailing edge 146, which also may be referred to as an interface between the extension plate 144 and the main screed plate 136, as well as along the entire length of the extension plate 144 (note that transition mark L2 may be at any position outward of the inner end 148). Thus, the single sensor 172 can sensor or detect when the transition mark L1 exists or the transition mark L2 exists.

In the case of multiple sensors 172 per screed extension 134, such as shown in FIG. 2, one sensor 172 may monitor the mat 120 formed behind the screed assembly 118 at the interface between the extension plate 144 and the main screed plate 136 and the other sensor 172 may monitor the mat 120 formed behind the screed assembly 118 outward of the interface. In this regard, according to embodiments of the disclosed subject matter, the sensor(s) 172 may move laterally as the screed extension 134 is extended or retracted relative to the main screed 132. Thus, according to one or more embodiments, the sensor(s) 172 may maintain relative positioning to sensor or detect the location(s) of the transition mark L1 and the transition mark L2. As yet another alternative, only one sensor 172 may be provided with a field of view wide enough to monitor the entire width of the mat 120 behind the screed assembly 118, from the outer ends 150 of the opposing screed extensions 134.

Discussed in more detail below, knowing the location of the undesirable surface condition formed on the mat 120 can be used as feedback to control positioning of the extension plates 144 of the screed extensions 134. In this regard, optionally, though each sensor 172 may directly sense or detect one or more undesirable surface conditions of the mat 120 itself, data captured by the sensor 172 pertaining to the surface condition of the mat 120 may be correlated or confirmed with position data of the screed extensions 134, for instance, how far each is extended, as measured by position sensors associated with (e.g., within) the powered screed width actuator 138, to determine the position of the undesirable surface condition. To be clear, however, embodiments of the disclosed subject matter may not have position sensors associated with the powered screed width actuators 138 or may not use data from such position sensors to identify location of the undesirable surface condition of the mat 120. For instance, one or more of the sensor(s) 172 may determine the existence of the undesirable surface condition (e.g., transition mark) and the width of the screed at which the undesirable surface condition occurs. In any event, embodiments of the disclosed subject matter can thus identify existence and location of the undesirable surface condition of the mat 120 no matter the amount by which the extension plates 144 are extended (including not extended).

The paving machine 100 may further include one or more frame inclinometers 180 (FIG. 1) mounted on the frame 102, and one or more screed inclinometers 182 (FIG. 2) mounted on the screed assembly 118. In one embodiment, the screed inclinometer(s) 182 may be mounted on the main screed 132. The frame inclinometer(s) 180 and the screed inclinometer(s) 182 may be any inclinometer, or the like, that measures angles of slope relative to a horizontal plane. The frame inclinometer(s) 180 can be configured to measure the slope of the frame, or ground engaging elements, relative to a horizontal plane (the "frame slope"). The screed inclinometer(s) 182 can be configured to measure either the slope of the main screed plate 136 relative to a horizontal plane or, alternatively, the slope of the main screed 132 relative to the horizontal plane (either one considered a "screed slope"). The screed inclinometer(s) 182 may alternatively or additionally measure pitch of the main screed 132 and/or main screed plate 136.

The screed assembly 118 may also include one or more angle of attack sensors 184 per screed extension 134. Each angle of attack sensor 184 can sense or detect an angle of the screed extension 134, particularly the extension plate 144 thereof. According to one or more embodiments, the angle of attack sensor 184 may be mounted on the extension plate 144. The angle of attack sensor 184 may be a linear sensor, such as an inclinometer, or a so-called smart sensor referenced level to earth. Discussed in more detail below, the angle sensed by each of the angle of attack sensors 184 may be referenced relative to an angle of attack sensed or detected by the screed inclinometer(s) 182 associated with the main screed 132. Additionally or alternatively, LiDAR may be used, for instance, as one or more of the sensors 172, to determine the angle of attack of the extension plate 144 of the screed extension 134.

The paving machine 100 may also include a controller 174. The controller 174 may include a processor 176 (FIG. 2) and a memory 178. The processor 176, which may be or include one or more processors, can be a microprocessor or microprocessors, for instance. The processor 176 may execute instructions and generate control signals to process data from one or more sensors (e.g., sensor(s) 172, 180, 182, 184). As noted above, such data, depending upon the sensor, may be representative of surface conditions or characteristics of the mat 120 and/or positioning of various components of the paving machine 100, such as the extension plate(s) 144. Such instructions, which can be executed by a computer, may be read into or embodied on a computer readable medium, such as the memory 178, or provided external to the processor 176. In alternative embodiments, hard wired circuitry may be used in place of, or in combination with, software instructions to implement a control method or methods. The controller 174 may be representative of at least a screed controller, for instance, a screed electronic control module (ECM), and optionally an overall machine controller, for instance, a machine ECM of the paving machine 100.

The term "computer readable medium" as used herein can refer to any non-transitory medium or combination of media that participates in providing instructions to the processor 176 for execution. Such a medium, which may be represented by the memory 178, may comprise all computer readable media except for a transitory, propagating signal. Forms of computer-readable media include, for example, a hard disk, magnetic tape, or any other magnetic medium, a CD-ROM, any other optical medium, or any other medium from which a computer processor 176 can read. The controller 174 is not limited to one processor 176 and memory 178. The controller 174 may be several processors 176 and memories 178.

The controller 174 can be operably connected to the sensors 172, as noted above, as well as the angle of attack sensor(s) 184, the frame inclinometer 180, and the screed inclinometer 182. The controller 174 may also be operably connected to the powered screed width actuators 138, the powered height actuators 140, and the powered screed extension angle of attack actuators 142. Thus, the controller 174 can receive data from the foregoing sensors (including the inclinometers), process the data, and send control signaling to the various actuators to control corresponding portions of the screed assembly 118 based on the processed data. According to one or more embodiments, the control signaling from the controller 174 can control the angle of attack and/or height of each screed extension 134, particularly the extension plate 144 thereof.

Here, the controller 174 can receive data from the sensor (s) (e.g., angle of attack sensors 184) associated with the extension plate 144 regarding angle of attack of the extension plates 144 and compare the data to baseline data. The baseline data may be or include the angle of attack of the main screed 132, particularly the main screed plate 136. The angle of attack of the main screed plate 136 may be zero, i.e., parallel with horizontal, or a positive angle of attack, for instance. According to one or more embodiments, the controller 174 can process such data to determine the angle of attack of each extension plate 144 and optionally the main screed 132 (alternatively the angle of attack of the main screed 132 may have been previously stored in the memory 178). Thus, the controller 174 may compare the angle of attack of the extension plate 144 with the angle of attack of the main screed 132. In some cases, the controller 174 can compare the angle of attack of the extension plate 144 with a previously detected angle of attack for the extension plate 144.

The controller 174 may determine whether the result of the comparison exceeds a predetermined offset or threshold amount. Under a condition that the result of the comparison exceeds the predetermined amount, the controller 174 can adjust the angle of attack the extension plate or plates 144. Such adjustment may be to increase or decrease the angle of attack relative to the main screed 132 (or the previously detected angle of attack of the same extension plate 144). Moreover, such adjustment may be to set the angle of attack of the extension plate 144 to within the predetermined offset or threshold amount. Here, the controller 174 can send control signaling to the powered screed extension angle of attack actuator 142 to adjust the angle of attack of the corresponding extension plate 144.

The controller 174 may also check, after the adjustment, to determine whether the angle of attack of the adjusted extension plate 144 remains within predetermined offset or threshold amount. In a case where the angle of attack does not remain within the predetermined offset amount this may be indicative of a malfunctioning, defective, or worn portion or portions of the screed assembly 118. In such a case, the controller 174 can output an alert onboard (e.g., to the operator station 112) and/or offboard the paving machine 100. Such alert may indicate that maintenance needs to be performed on the screed assembly 118. Thus, the alert may be referred to or characterized as a maintenance alert.

The analysis of the detected angle of attack of the extension plate(s) 144 may occur, at least initially, when the paving machine 100 is stationary. That is, the foregoing operations of checking the angle of attack of the extension plates 144 and, if needed, adjusting the angle of attack of one or more of the extension plates 144, may be performed when the paving machine 100 is stationary and prior to performing paving operations. For instance, such operations can be performed at startup of the paving machine 100, for instance, to reliably identify that the angle of attack of each extension plate 144 is at least starting from a suitable value, for instance, to prevent or minimize formation of undesirable surface conditions on the mat 120.

According to one or more embodiments of the disclosed subject matter, the controller 174 can additionally or alternatively check the angle of attack of the extension plates 144 while the paving machine 100 is moving in a paving direction and processing the paving material and create the mat 120. Such checking may be periodic, for instance, according to a predetermined period of time or a predetermined distance traveled by the paving machine 100.

The controller 174 can receive data from the sensor(s) (e.g., angle of attack sensors 184) associated with the extension plate 144 regarding angle of attack of the extension plates 144 and compare the data to baseline data. Such baseline data may be or include the angle of attack of the main screed 132, particularly the main screed plate 136. According to one or more embodiments, the controller 174 can process such data to determine the angle of attack of each extension plate 144 and optionally the main screed 132 (alternatively the angle of attack of the main screed 132 may have been previously stored in the memory 178). Thus, the controller 174 may compare the angle of attack of the extension plate 144 with the angle of attack of the main screed 132. In some cases, the controller 174 can compare the angle of attack of the extension plate 144 with a previously detected angle of attack for the extension plate 144.

The controller 174 may also determine whether the result of the comparison exceeds a predetermined offset or threshold amount. The predetermined offset or threshold amount may be referred to or characterized as a dead band. The dead band may be to account for acceptable dynamic movement of the screed extension 134 during paving operations of the paving machine 100.

Under a condition that the result of the comparison exceeds the predetermined offset or threshold amount, the controller 174 can adjust the angle of attack the extension plate or plates 144 falling outside the allotted predetermined amount. Such adjustment may be to increase or decrease the angle of attack of the extension plate 144 relative to the main screed plate 136 of the main screed 132. Moreover, such adjustment may be to set the angle of attack of the extension plate 144 to within the predetermined offset or threshold amount. Here, the controller 174 can send control signaling to the powered screed extension angle of attack actuator 142 to adjust the angle of attack of the corresponding extension plate 144.

After the paving machine 100 has traveled a predetermined distance, for instance, three to four tow lengths (inclusive), which may be determined by the controller 174, it may be determined whether the undesirable surface condition remains. As noted above, the tow arm 128 can connect the screed assembly 118 to the frame 102 of the paving machine 100. The tow point can be where the tow arm 128 connects to the frame 102 and can pivot up and down, i.e., the screed assembly 118 can rise and fall around this pivot point. Hence, a tow length may be defined as a length or distance from the towing or pivot point of the tow arm 128 to the front of the screed assembly 118. The controller 174 may determine the predetermined distance using, for instance, speed sensors (e.g., number of revolutions of wheels) to determine how far the paving machine 100 has traveled. The predetermined distance may be set to allow the entire screed assembly 118 to come into balance after the angle of attack adjustment to one or more screed extensions 134.

The adjustment of the angle of attack of the screed extension 134 may be based on dynamic operating conditions of the paving machine 100 and/or a change in an amount by which the screed extension 134 extends from the main screed 132 of the paving machine 100. For instance, the adjustment process may be performed multiple times as the paving machine 100 is moving, to set the angle of attack of the screed extension 134 to a prescribed value. Additionally, the amount by which the screed extension 134 extends may affect the load of the screed extension 134 and thus the amount of pitch experienced by the screed extension 134. Thus, the amount by which the angle of attack is adjusted may factor in the extension amount of the screed extension 134.

According to one or more embodiments, the controller 174 may provide an alert, for instance, to the operator station 112, that the paving machine 100 has traveled the predetermined distance. This may prompt the operator to check for any continuing undesirable surface conditions of the mat 120. If the undesirable surface condition remains, the controller 174 can further adjust the angle of attack of the associated extension plate 144. After another predetermined distance it may again be determined whether the undesirable surface condition is still being created by the screed assembly 118. These processes may repeat until the undesirable surface condition no longer occurs. According to one or more embodiments, the adjustment of the angle of attack of the extension screed 134 may occur without adjusting the height of the extension screed 134.

According to one or more embodiments, the controller 174 may send an alert, for instance, to the operator station 112 and/or offboard the paving machine 100 under a condition that the undesirable surface condition does not go away or returns. Additionally or alternatively, the controller 174 may send an alert, for instance, to the operator station 112 and/or offboard the paving machine 100 under a condition that the extension screed 134 angle of attack has changed without being instructed to do so (outside of expected dynamic operating changes) and/or needs to be adjusted a predetermined number of times over a set period of time or distance of movement of the paving machine 100. Such conditions may be representative of component wear, etc. and a need to perform maintenance on the paving machine 100.

Additionally or alternatively, as noted above, the controller 174 can be operably connected to the sensors 172. The controller 174 may also be operably connected to the powered height actuators 140. Thus, the controller 174 can receive data from the sensors 172, process the data, and send control signaling to the powered height actuators 140 to control the height of each screed extension 134, particularly the extension plate 144 thereof.

The data from the sensor(s) 172 may be indicative of an undesirable surface condition of the mat 120, such as a transition mark (e.g., ridge or line) mentioned above. Optionally, the controller 174 can characterize the undesirable surface condition of the mat 120, for instance, as a ridge or line, a change in texture or density, etc.

The controller 174 can receive data from the sensor(s) 172 per screed extension 134 and optionally position data of the screed extensions 134, for instance, how far each is extended as measured by position sensors associated with (e.g., within) the powered screed width actuator 138, to determine a position of the undesirable surface condition. As noted above, as an example, as shown in FIG. 2, the undesirable surface condition can be signified by the transition mark L1 at the inner end 148 of the extension trailing edge 146, which also may be referred to as an interface between the extension plate 144 and the main screed plate 136, or the transition mark L2, which is outward of the inner end 148, along the length of the extension plate 144 (transition mark L2 may be at any position outward of the inner end 148).

The controller 174 can adjust the height of the extension plate 144 of the screed extension 134 based on at least the identified location of the transition mark L1/L2 (possibly one per extension plate 144). In particular, the controller 174 can raise the height of the extension plate 144 under a condition where the location of the transition mark is identified as being associated with the inner end 148 of the extension plate 144, i.e., the interface between the screed extension 134 and the main screed 132. Transition mark L1 is an example of such transition mark. The controller 174 can lower the height of the extension plate 144 under a condition where the location of the transition mark is identified as being outward of the inner end 148 of the extension plate 144, along the length of the extension plate 144. Transition mark L2 is an example of such transition mark. Here, the height of the extension plate 144 may be adjusted without adjusting the angle of attack of the extension plate 144. If no transition mark is identified behind the screed assembly 118 as the paving machine 100 moves, the controller 174 may maintain the extension plate 144 at a current height.

After the paving machine 100 has traveled a predetermined distance, for instance, three to four tow lengths (inclusive), which may be determined by the controller 174, it may be determined whether the transition mark remains, i.e., is still being created by the paving machine 100. As noted above, tow length may be defined as a length or distance from the towing or pivot point of the tow arm 128 to the front of the screed assembly 118. The controller 174 may determine the predetermined distance using, for instance, speed sensors (e.g., number of revolutions of wheels) to determine how far the paving machine 100 has traveled. The predetermined distance may be set to allow the entire screed assembly 118 to come into balance after the height adjustment for one or more of the screed extensions 134.

If the transition mark remains, for instance, based on further data from one or more of the sensor(s) 172, the controller 174 can further adjust the height of the associated extension plate 144 of the extension screed 134. After another predetermined distance it may again be determined whether the transition mark remains. These processes may repeat until the transition mark is no longer created by the screed assembly 118.

INDUSTRIAL APPLICABILITY

As noted above, embodiments of the disclosed subject matter relate to systems, apparatuses, and methods for controlling one or more screed extenders or extensions of paving machines.

Incorrect angle of attack for a screed extension or extender can lead to undesirable surface conditions for the mat, such as a texture or density different relative to the main screed. For instance, if the angle of attack for the screed extension is too much, more material can go under the main screed and actually lift up the screed assembly. As a result, the screed extensions will carry more of the load of the screed assembly and the texture of the mat behind the screed assembly will be more closed, shinier, and/or compacted compared to the mat behind the main screed. This may cause a mat defect due to the different styles in compaction levels as the asphalt cools and before the asphalt compactor compacts the surface. Likewise, the inverse is also true. If the angle of attack for the screed extension is too little, or even a negative angle of attack, now the main screed carries more of the load and not as much paving material is provided under the screed extensions. This can result in more of an open texture on the screed extensions and a tighter texture on the main screed (i.e., texture difference). This may also result in not enough asphalt coming under the screed extensions, meaning that the flow of asphalt under the screed plate may be cut off. When the compactor comes through the compactor may compact down to a lower level associated with the screed extensions as compared to the main screed, which can result in a dip or longitudinal bump in the mat (i.e., texture problem) and hence a mat defect. The foregoing may be caused by damage to the screed assembly during transport or wear of bushings, for instance. This may cause the screed extension angle of attack to be out of adjustment. Often when this occurs it can be too late to fix the screed extension angle of attack before paving begins.

With at least the foregoing in mind, embodiments of the disclosed subject matter can involve a system and method for adjusting an angle of attack of a screed extender or extension associated with an asphalt paver. The system can include a sensor and a controller (e.g., an ECM). The sensor can measure a desired angle of attack of the screed extension based on dynamic operating conditions of the paving machine. Further, the sensor can transmit the measured angle to the controller, which can dynamically adjust the angle of attack of the screed extension for acceptable dynamic roll during paving operations. In an embodiment, if the sensor measures the angle of attack outside a target value, the system can notify an operator, thereby indicating a machine maintenance requirement, for instance.

There can be a target value and a dead band around the desired setting that may be dynamically adjusted during machine performance to account for acceptable dynamic role during paving operations. If the sensor detects that the screed extension angle of attack is outside the target value an error or fault can be communicated to the operator indicating that the paving machine will need maintenance before use. During normal paving operations the screed extension may elastically roll forward reducing the angle of the screed extension relative to the main screed. To account for this, embodiments of the disclosed subject matter can monitor the angle of attack of the screed extension as the paving machine moves and adjust the angle of attack to within a predetermined desired vale.

Thus, embodiments of the disclosed subject matter can ensure or make more likely that the angle of attack for each screed extension is correct or within a desired range (e.g., factory specifications, previously determined and stored value, etc.) prior to operation of the paving machine. Additionally or alternatively, embodiments of the disclosed subject matter can automatically, rather than manually, adjust the angle of attack of the screed extension as the paving machine is moving forward and performing paving operations. Optionally, notifications may be sent to the operator and/or offboard the paving machine regarding maintenance, for instance, under a condition that the angle of attack has changed (or keeps changing) without being requested to change.

Figure 5:
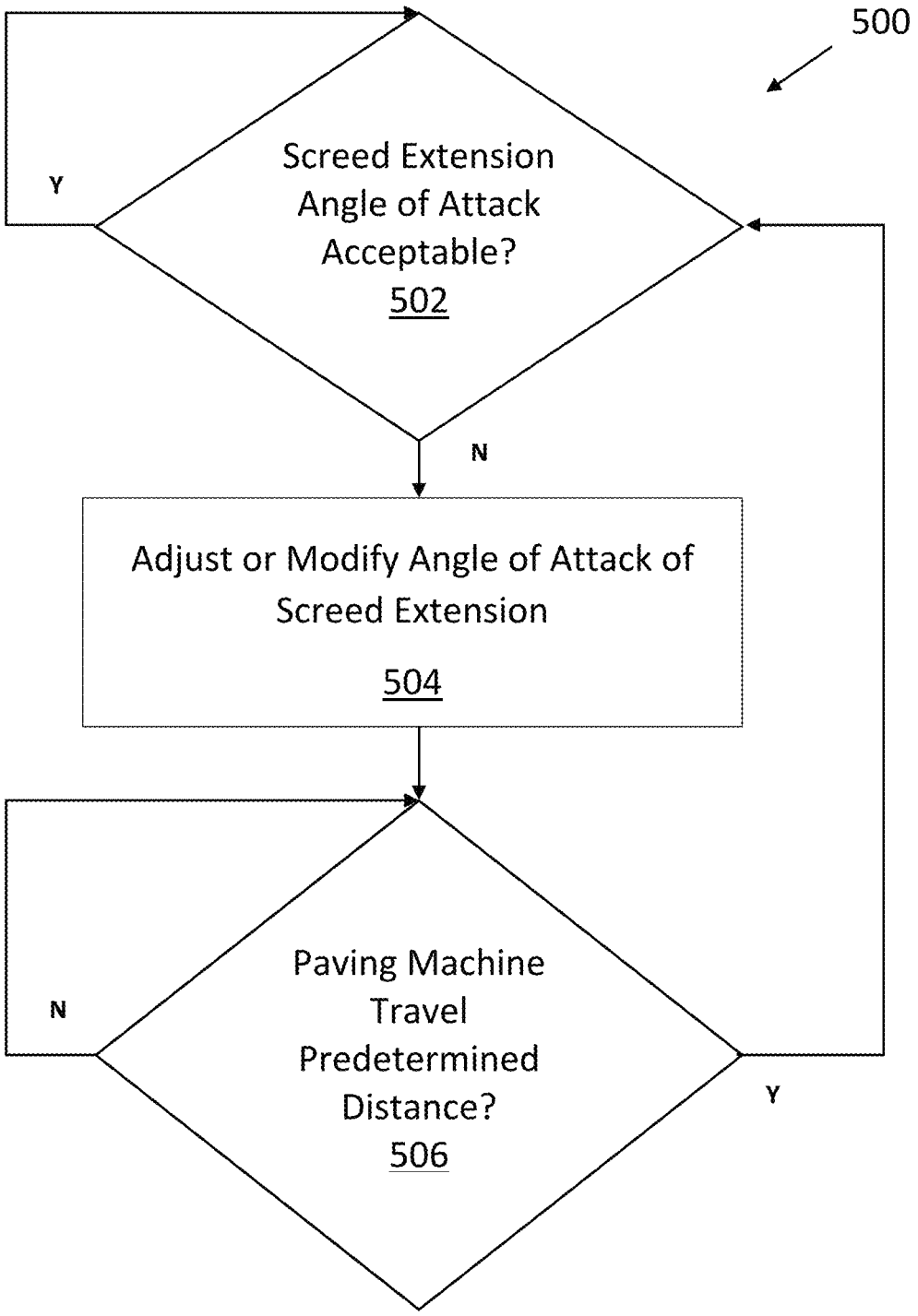
FIG. 5 is flow chart of a control method according to one or more embodiments of the disclosed subject matter.

FIG. 5 is flow chart of a control method 500 according to one or more embodiments of the disclosed subject matter. A non-transitory computer-readable storage medium, such as memory 178, having stored thereon instructions that, that when executed by one or more processors 176 of a paving machine, such as paving machine 100, can cause the one or more processors 176 to perform the method 500. For instance, the controller 174 may perform some or all of the operations of the method 500.

The method 500, at step or operation 502, can check whether the angle of attack for each screed extension 134, particularly the extension plate 144 thereof, is acceptable. Acceptable can mean within a predetermined limit or threshold compared to the main screed 132, particularly the main screed plate 136 thereof. Additionally or alternatively the angle of attack of the extension plate 144 can be compared to a previous determination of the angle of attack for the same extension plate 144. Data regarding the angle of attack for the extension plate 144 can be provided by the angle of attack sensor 184. That is, the angle of attack of the extension plate 144 can be determined from data from the angle of attack sensor 184 associated with the particular extension plate 144. Additionally or alternatively, one or more of the sensors 172 can be used to determine the angle of attack of the extension plate 144.

Under a condition that the angle of attack of the extension plate 144 is not acceptable, i.e., does not fall within the predetermined limit or threshold, at step or operation 504 the method 500 can adjust the angle of attack of the extension plate 144. Such adjustment may be to increase or decrease the angle of attack relative to the main screed 132 (or the previously detected angle of attack of the same extension plate 144). Moreover, such adjustment may be to set the angle of attack of the extension plate 144 to within the predetermined offset or threshold amount. Here, the controller 174 can send control signaling to the powered screed extension angle of attack actuator 142 to adjust the angle of attack of the corresponding extension plate 144.

The foregoing operations can be performed when the paving machine 100 is stationary, for instance, prior to commencing paving operations. The foregoing operations may also be performed when the paving machine 100 is moving and performing paving operations.

According to one or more embodiments, after the paving machine 100 has traveled a predetermined distance, for instance, three to four tow lengths (inclusive), according to operation or step 506, which may be determined by the controller 174, it may be determined whether the screed extension 144 angle of attack is acceptable. Here, this can be representative of the angle of attack falling outside of the predetermined offset or threshold amount and/or creation of an undesirable surface condition on the mat 120.

Additionally or alternatively, if a screed extension is not at a correct height, a transition mark may be created behind the paving machine. Here, when the screed extension is too low the screed extension can push more asphalt, whereas when the screed extension is too high the screed extension can leave material. This may mean that a transition mark at the inner edge of the screed extension may indicate that the screed extension is too low because the screed extension is pushing down the paving material and hence leaving the transition mark (step down in this case). On the other hand, if the transition mark is coming from anywhere within the length of the screed extension, i.e., outward of the inner edge of the screed extension, this may indicate that the screed extension is too high because the screed extension, at least at some point along its length, is not pushing down the paving material and hence leaving the transition mark (step up in this case).

Thus, embodiments of the disclosed subject matter can additionally or alternatively involve an adjusting screed extension height system and method for a paving machine. More particularly, embodiments of the present disclosure can pertain to an automatic screed extension height adjusting system and method on a paving machine. The system and method, according to one or more embodiments, can include a visual, non-contact smart sensor, smart camera, lidar or similar device that monitors the mat created by the screed. A controller, interfacing with the sensors, can determine the cause when a ridge in the mat is detected, and send a signal to power the screed extension height mechanism to either raise or lower the screed extension. Further, the command can continue, i.e., maintain, the screed extension at the current height, until the sensors detect the removal of the ridge.

Figure 6:
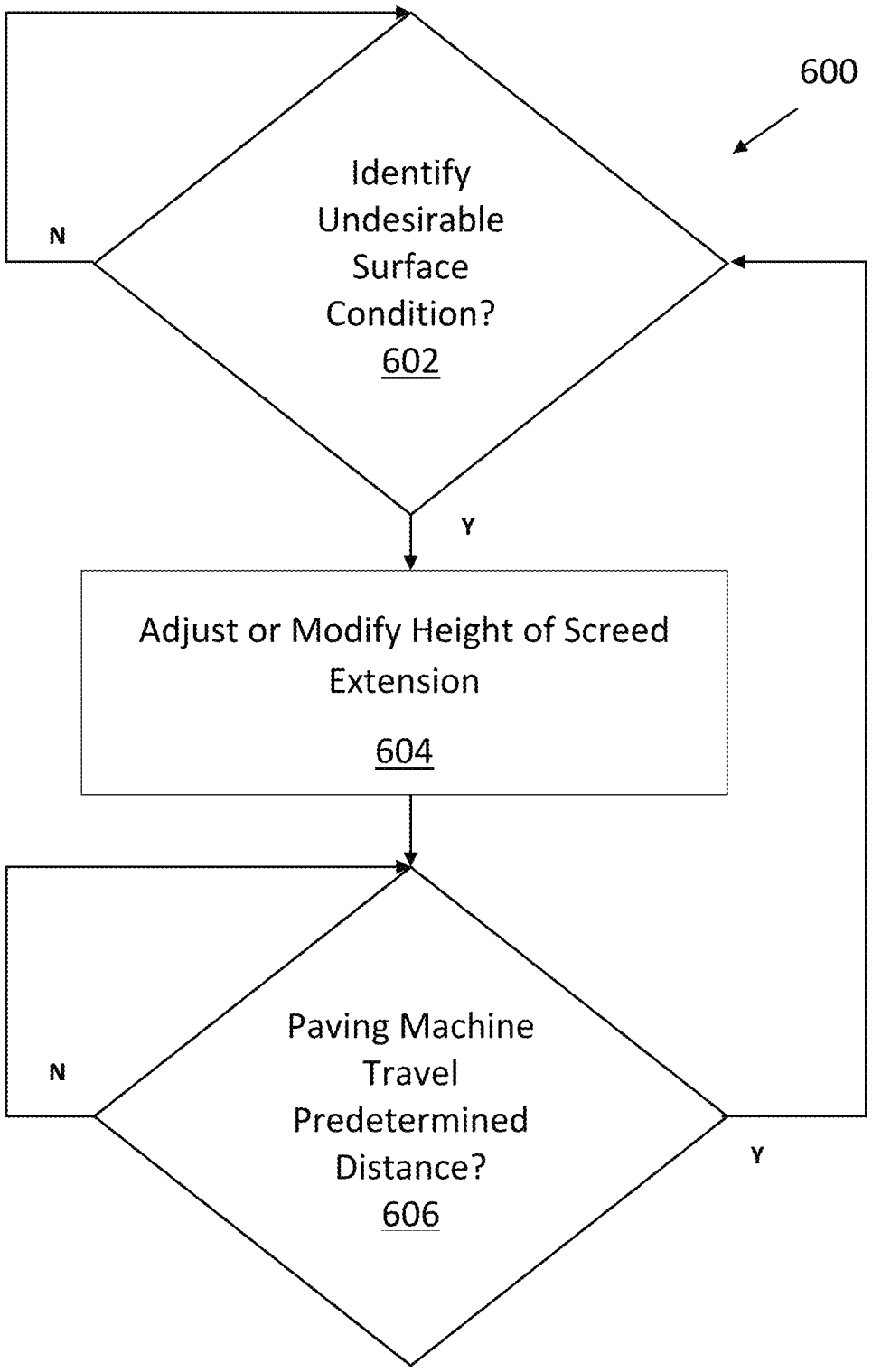
FIG. 6 is flow chart of a control method according to one or more embodiments of the disclosed subject matter.

FIG. 6 is flow chart of a control method 600 according to one or more embodiments of the disclosed subject matter. A non-transitory computer-readable storage medium, such as memory 178, having stored thereon instructions that, that when executed by one or more processors 176 of a paving machine, such as paving machine 100, can cause the one or more processors 176 to perform the method 600. For instance, the controller 174 may perform some or all of the operations of the method 600.

The method 600, at step or operation 602, can identify existence of an undesirable surface condition of the mat 120. As noted above, examples of undesirable surface conditions can include a transition mark (e.g., line or ridge), a change in density of the mat 120, and/or a change in texture of the mat 120. Notably, operation 602 can include identification of a location of the undesirable surface condition of the mat 120.

As an example, as shown in FIG. 2, the undesirable surface condition can be signified by the transition mark L1 at the inner end 148 of the extension trailing edge 146 or the transition mark L2, which is outward of the inner end 148, along the length of the extension plate 144 (transition mark L2 may be at any position outward of the inner end 148).

At operation or step 604, the method 600 can, under a condition that the undesirable surface condition is identified (existence and location), can control the height o the extension plate 144. In particular, the height of the extension plate 144 can be raised under a condition where the location of the transition mark is identified as being associated with the inner end 148 of the extension plate 144, and the height of the extension plate 144 can be lowered under a condition where the location of the transition mark is identified as being outward of the inner end 148 of the extension plate 144, along the length of the extension plate 144.

According to one or more embodiments, after the paving machine 100 has traveled a predetermined distance, for instance, three to four tow lengths (inclusive), according to operation or step 606, which may be determined by the controller 174, it may be determined whether the screed extension 144 height is acceptable. Here, this can be representative of further or continued existence of an undesirable surface condition of the mat 120 (same or different undesirable surface condition as before).

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A paving machine for paving a mat on a base, the paving machine comprising:

a plurality of sensors to sense a surface characteristic of the mat;

a screed assembly; and a controller operatively coupled to the sensors and the screed assembly, wherein the screed assembly includes:

a main screed having a main screed plate, a first screed extension having a first extension plate, the first extension plate defining a first rear edge of the first screed extension, and the first screed extension being configured to be positioned outward of the main screed on a first end of the main screed in a front elevational view of the screed assembly, and a second screed extension having a second extension plate, the second extension plate defining a second rear edge of the second screed extension, the second screed extension being configured to be positioned outward of the main screed on a second end of the main screed opposite the first end in the front elevational view of the screed assembly, wherein a first set of the plurality of sensors is to sense the surface characteristic of the mat associated with the first extension plate of the first screed extension, wherein a second set of the plurality of sensors is to sense the surface characteristic of the mat associated with the second extension plate of the second screed extension, and wherein the controller is configured to, for each of the first extension plate and the second extension plate:

identify, as said surface characteristic, a location of a ridge formed in the mat associated with the first extension plate or the second extension plate, using data from the first set of sensors or the second set of sensors, respectively, the ridge running in a direction of travel of the paving machine, and the location of the ridge being associated with either an inner end of the first extension plate or the second extension plate or outward of the inner end, along a length of the first extension plate or the second extension plate, and control a height of the first extension plate or the second extension plate responsive to the identification of the location of the ridge.

2. The paving machine according to claim 1, wherein for each of the first extension plate and the second extension plate the controller is configured to control the height of the first extension plate or the second extension plate:

to raise the first extension plate or the second extension plate under a first condition that the location of the ridge is identified as being associated with the inner end, and to lower the first extension plate or the second extension plate under a second condition that the location of the ridge is identified as being associated with along the length of the first extension plate or the second extension plate.

3. The paving machine according to claim 1, wherein for each of the first extension plate and the second extension plate the controller is configured to:

control the height of the first extension plate or the second extension plate by raising or lowering the height by a predetermined amount based on the identification of the location of the ridge, and determine presence or absence of the ridge a predetermined distance after controlling the height of the first extension plate or the second extension plate, wherein the predetermined distance is in a range of three to four tow lengths, inclusive.

4. The paving machine according to claim 1, wherein for each of the first extension plate and the second extension plate the controller is configured to:

identify, using the data from the first set of the sensors or the second set of the sensors, whether the ridge is present, and maintain the height of the first extension plate or the second extension plate under a condition that no ridge is identified as being present.

5. The paving machine according to claim 1, wherein each of the first set of the sensors and the second set of the sensors is comprised of multiple sensors.

6. The paving machine according to claim 1, wherein the control of the height of the first extension plate is independent of the control of the height of the second extension plate.

7. The paving machine according to claim 1, wherein the identification of the location of the ridge formed in the mat associated with each of the first extension plate and the second extension plate is based on a determination by the controller of an amount of extension of each of the first extension plate and the second extension plate.

8. The paving machine according to claim 1, further comprising:

a first angle of attack sensor for the first screed extension; and a second angle of attack sensor for the second screed extension, wherein the controller is configured to compare an angle of attack for each of the first screed extension and the second screed extension based on data from the first angle of attack sensor and the second angle of attack sensor, respectively, to an angle of attack of the main screed, and adjust the angle of attack for each of the first screed extension and the second screed extension under a condition that a result of the comparison exceeds a predetermined offset amount.

9. A method for controlling a paving machine comprising:

determining, using a controller, with the paving machine stationary, a first angle of attack of a screed extension of the paving machine, said determining being based on angle of attack data from an angle of attack sensor associated with the screed extension;

comparing, using the controller, with the paving machine stationary, the first angle of attack of the screed extension with a second angle of attack of a main screed of the paving machine;

determining, using the controller, with the paving machine stationary, whether a result of said comparing exceeds a predetermined threshold; and adjusting, under control of the controller, with the paving machine stationary, the first angle of attack of the screed extension to within the predetermined threshold responsive to a condition where the result exceeds the predetermined threshold, wherein the predetermined threshold represents a dead band to account for acceptable dynamic movement of the screed extension during paving operations of the paving machine.

10. The method according to claim 9, further comprising:

after said adjusting the first angle of attack of the screed extension, checking, using the controller, whether the first angle of attack remains within the predetermined threshold; and outputting, using the controller, a maintenance alert under a condition that the first angle of attack fails to remain within the predetermined threshold according to one or more predetermined criteria.

11. The method according to claim 9, further comprising:

adjusting, using the controller, with the paving machine moving, the first angle of attack of the screed extension responsive to identification of an undesirable characteristic of a mat paved on a base by the paving machine;

determining, using the controller, with the paving machine moving, whether the paving machine has traveled a predetermined distance after said adjusting the first angle of attack;

after the predetermined distance, determining whether the undesirable characteristic remains; and repeating said adjusting and said determining whether the paving machine has traveled the predetermined distance under a condition where the undesirable characteristic is determined to remain after the predetermined distance.

12. The method according to claim 11, wherein said adjusting with the paving machine moving is based on dynamic operating conditions of the paving machine and based on a change in an amount by which the screed extension extends from the main screed of the paving machine.

13. The method according to claim 11, further comprising:

identifying, using the controller, with the paving machine moving, a location of a line formed in the mat in a travel direction of the paving machine using data from one or more sensors, the location of the line being associated with either an inner end of the screed extension or outward of the inner end, along a length of the screed extension; and controlling, using the controller, with the paving machine moving, a height of the screed extension responsive to said identifying the location of the line.

14. A non-transitory computer-readable storage medium having stored thereon instructions that, when executed by one or more processors of a paving machine, cause the one or more processors to perform a method comprising:

identifying a location of an undesirable surface condition of a mat paved on a base by the paving machine using data from one or more sensors associated with a screed extension;

characterizing the undesirable surface condition of the mat; and adjusting a height and/or an angle of attack of an extension plate of the screed extension to prevent future occurrences of the undesirable surface condition responsive to the identification and characterization of the undesirable surface condition, wherein the location of the undesirable surface condition represents a start of the undesirable surface condition in a transverse direction of the paving machine and is associated with either an interface between the screed extension and a main screed or outward of the interface, along a length of the extension plate of the screed extension.

15. The non-transitory computer-readable storage medium according to claim 14, wherein the undesirable surface condition is a ridge, a difference in texture, and/or a difference in density that extends in a moving direction of the paving machine.

16. The non-transitory computer-readable storage medium according to claim 14, wherein said adjusting includes adjusting the height and the angle of attack of the extension plate, and wherein the method further comprises:

determining whether the paving machine has traveled a predetermined distance after said adjusting the height and angle of attack of the extension plate;

determining whether the undesirable surface condition is still created on the mat responsive to the paving machine having been determined to have traveled the predetermined distance; and under a condition that the undesirable surface condition is still being created on the mat, adjusting the height and/or the angle of attack of the screed extension to prevent future occurrences of the undesirable surface condition on the mat.

17. The non-transitory computer-readable storage medium according to claim 14, wherein said adjusting includes adjusting the angle of attack of the screed extension and not the height of the screed extension, said adjusting the angle of attack of the screed extension including:

comparing, with the paving machine moving, the angle of attack of the screed extension with an angle of attack of the main screed of the paving machine;

determining whether a result of said comparing exceeds a predetermined threshold; and setting the angle of attack of the screed extension within the predetermined threshold from the angle of attack of the main screed under a condition that the result of said comparing exceeds the predetermined threshold.

18. The non-transitory computer-readable storage medium according to claim 14, wherein said adjusting with the height and/or the angle of attack of the screed extension is based on dynamic operating conditions of the paving machine and based on a change in an amount by which the screed extension extends from the main screed of the paving machine.

19. The non-transitory computer-readable storage medium according to claim 14, wherein said adjusting includes adjusting the height of the screed extension and not the angle of attack of the main screed, wherein said adjusting the height of the screed extension raises the extension plate of the screed extension under a first condition that the location of the undesirable surface condition is identified to start at the interface between the screed extension and the main screed, and wherein said adjusting the height lowers the height of the extension plate of the screed extension under a second condition that the location of the undesirable surface condition is identified as starting along the length of the extension plate of the screed extension.

20. The non-transitory computer-readable storage medium according to claim 14, wherein the method further comprises outputting a maintenance alert to an operator station of the paving machine based on the characterization of the undesirable surface condition of the mat.

* * * * *